United States Patent [19]

Yamada et al.

[11] Patent Number: 4,939,498

[45] Date of Patent: Jul. 3, 1990

[54] PTC THERMISTOR DEVICE WITH PTC THERMISTOR UNIT HOUSED IN CASE

[75] Inventors: Yoshihiro Yamada; Hisao Enomoto, both of Nagaokakyo, Japan

[73] Assignee: Murata Manufacturing Co., Ltd., Japan

[21] Appl. No.: 314,981

[22] Filed: Feb. 24, 1989

[30] Foreign Application Priority Data

Feb. 26, 1988 [JP] Japan ..... 63-045609

[51] Int. Cl.[5] ..... H01C 7/10

[52] U.S. Cl. ..... 338/22 R; 338/220

[58] Field of Search ..... 338/22 R, 22 SD, 220, 338/221

[56] References Cited

U.S. PATENT DOCUMENTS 3,878,501 4/1975 Moorhead et al. ..... 338/22 R
3,914,727 10/1975 Fabricius ..... 338/22 R
4,401,885 8/1983 Ishii et al. ..... 338/22 R X
4,431,983 2/1984 Rodriguez ..... 338/22 R X
4,482,801 11/1984 Habata et al. ..... 338/22 R X

*Primary Examiner*—George H. Miller, Jr.
*Assistant Examiner*—Marvin M. Lateef
*Attorney, Agent, or Firm*—Ostrolenk, Faber, Gerb & Soffen

[57] ABSTRACT

A PTC thermistor device includes a case in which a holding plate made of metallic material is vertically arranged; and on each of both main surfaces of the holding plate, an electrode from a respective one of two PTC thermistor units is fixed. Therefore, the two PTC thermistor units are thermally coupled with each other through the holding plate. A terminal is integrally formed at the lower end of the holding plate, which is exposed outside the case. A throughhole for reducing an area of a section of a heat conduction path from the holding plate to the terminal is formed in the heat conduction path.

7 Claims, 2 Drawing Sheets

PTC THERMISTOR DEVICE WITH PTC THERMISTOR UNIT HOUSED IN CASE

BACKGROUND OF THE INVENTION

1. Field of the Invention

The present invention relates to a PTC thermistor device with a PTC thermistor unit housed in a case. More specifically, the present invention relates to a PTC thermistor device which is utilized in a degaussing circuit of a cathode ray tube (CRT).

2. Description of Prior Art

In a CRT circuit of a television receiver or the like, as shown in FIG. 1, by turning on a switch 1, degaussing current is caused to flow to a degaussing coil 3 via a PTC (Positive Temperature Coefficient) thermistor 2. When the degaussing is terminated, the current flowing in the degaussing coil 3 is reduced by increasing a resistance value of the PTC thermistor 2. To this end, a PTC thermistor 4 for heating is thermally coupled to the PTC thermistor 2. More specifically, at a time just after the turn on of the switch 1, the resistance value of the PTC thermistor 2 is small since its temperature is low, and therefore, a relatively large degaussing current flows in the degaussing coil 3. However, when the PTC thermistor 2 is heated by the PTC thermistor 4, since the resistance value of the PTC thermistor 2 increases, the current flowing the degaussing coil 3 is reduced.

As shown in FIG. 2, units of such two PTC thermistors 2 and 4 are respectively fixed on both main surfaces of a single holding plate 5 so as to be thermally coupled to each other. Then, in order to prevent the heat from being dispersed, the units of the PTC thermistors 2 and 4 and the holding plate 5 are accommodated or housed in a case 6. Terminals 7–9 connected to electrodes of the units of the PTC thermistors 2 and 4 are withdrawn to the outside the case 6. Thus, the PTC thermistor device is constructed.

On the other hand, in the above described CRT circuit, when the degaussing operation is terminated, in order to minimize the consumption of the electric power, it is necessary to make the current flowing the degaussing coil 3 as small as possible. Therefore, in the PTC thermistor device utilized in the CRT circuit, it is necessary to heighten a thermal equilibrium temperature of the units of the PTC thermistors 2 and 4 as much as possible by strengthening the thermal coupling between the units of the PTC thermistors 2 and 4. If and when the holding plate is made of a metallic material, the heat generated by the PTC thermistor 4 is easily dispersed through the holding plate 5 and the terminal 7. Therefore, in practice, it was impossible to heighten the thermal equilibrium temperature of the units of the PTC thermistors 2. Furthermore, in the case where a coefficient of thermal conductivity of such a metallic material is high, since the heat generated by the PTC thermistor 4 is transferred to a printed circuit board (not shown) through the terminal 7, occur such as solder on the printed circuit board being melted, and the other electronics components being thermally destroyed.

SUMMARY OF THE INVENTION

Therefore, an object of the present invention is to provide a novel PTC thermistor device with a PTC thermistor unit housed in a case.

Another object of the present invention is to provide such a PTC thermistor device capable of heightening a thermal equilibrium temperature of a PTC thermistor unit.

A further object of the present invention is to provide a PTC thermistor device which does not transfer thermal influences to a printed circuit board and so on.

A PTC thermistor device in accordance with the present invention comprises a case; a holding member housed in the case and made from a metallic material; a PTC thermistor unit having electrodes on the both main surfaces, one of said electrodes being connected to the holding member; a first terminal connected to the holding member and exposed outside the case; a second terminal connected to the other of the electrodes of the PTC thermistor unit and exposed to the outside of the case; and a heat conduction-suppressing portion formed in heat conduction path between the holding member and the first terminal for suppressing a heat conduction from the holding member to the first terminal.

In a preferred embodiment, an area of a section of the heat conduction path made be made small by forming a throughhole or a notch in the heat conduction path. Such area then functions as the heat conduction-suppressing portion.

The PTC thermistor unit is held by the holding member within the case. Therefore, heat produced by the PTC thermistor unit is transferred to the holding member. However, since the heat conduction-suppressing portion is formed in the heat conduction path between the holding member and the first terminal, the heat conduction from the holding member to the first terminal can be effectively suppressed.

In accordance with the invention, heat can be suppressed from being conducted from the holding member to the terminal by the heat conduction-suppressing portion, thus making it is possible to heighten a thermal equilibrium temperature of the PTC thermistor unit.

In addition, since heat is suppressed from being transferred to a printed circuit board through the terminal, disadvantages such that solder on the printed circuit board is melted, and that other electronics components are thermally destroyed and so on are avoided.

The foregoing and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENTS

Figure 3:
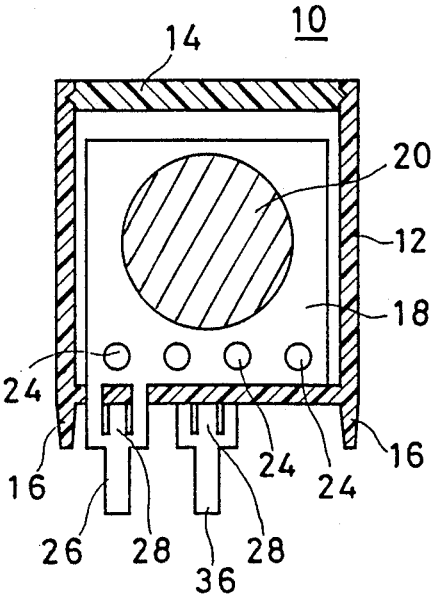
FIG. 3 is an illustrative view showing a transversal section of one embodiment in accordance with the present invention.
Figure 4:
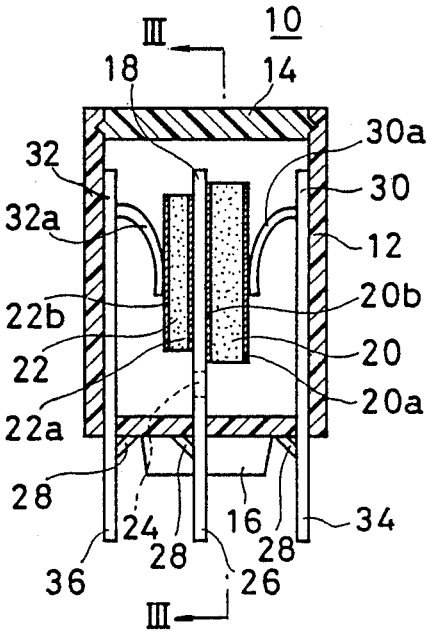
FIG. 4 is an illustrative view showing a vertical section of FIG. 3 embodiment.

With reference to FIGS. 3 and 4, a PTC thermistor device with a PTC thermistor unit housed in a case (hereinafter, referred to simply as "a PTC thermistor device") 10 of one embodiment in accordance with the present invention includes a case 12, the upper end opening of which is closed or sealed by a cover 14. Such case 12 and a cover 14 are made from heat resistant resin. At the lower end of the case 12, spacers 16 for spacing the bottom surface of the case 12 from a printed circuit board (not shown) are integrally formed at both sides. Since the printed circuit board and the bottom surface of the case 12 are spaced from each other by the spacers 16, heat is prevented from being directly transferred from the bottom surface of the case 12 to the printed circuit board.

Inside the case 12, a holding plate 18 having a rectangular shape is vertically arranged at the center of the case 12 or in the vicinity thereof. PTC thermistor units 20 and 22 each having a disk-like shape are fixed on main surfaces of the holding plate 18. On both main surfaces of the PTC thermistor units 20 and 22, electrodes 20*a* and 20*b* and 22*a* and 22*b* are respectively formed by metallizing with silver, for example.

Therefore, when the PTC thermistor units 20 and 22 are respectively fixed on the holding plate 18, the electrodes 20*b* and 22*a* are respectively connected to the holding plate so as to be commonly connected to it.

The holding plate 18 is made from a metallic material such as a stainless steel, German silver, phosphor bronze or the like. Therefore, when one PTC thermistor unit 20 generates heat, the heat is transferred at high efficiency to the other PTC thermistor unit 22 through the holding plate 18. A plurality of throughholes 24 are formed at a lower portion of the holding plate 18 in such a manner that the same are distributed in a direction of width of the holding plate 18. The throughholes 24 function as a heat conduction-suppressing portion. More specifically, an area of section of a portion where the throughholes 24 are formed is reduced, and therefore, since the thermal resistance becomes high at that portion, heat conduction from above the portion where the throughholes are formed to below that portion can be suppressed.

A terminal 26 is integrally formed at a portion of the holding plate 18 at left the lower as viewed in FIG. 3. The holding plate 18 is inserted in the case 12 in the state where the cover 14 is removed from the case 12. At such time, the terminal 26 is exposed outside the case 12 through a slit (not shown) which has been formed the case 12 in advance, and the holding plate 18 itself is fixed to the inside of the case 12. When the terminal 26 is passed through the slit, as shown in FIG. 4, bent pieces 28 expand outwardly by an elastic force thereof. Thus, the bent pieces 28 engage with the bottom surface of the case 12, and therefore, the holding plate 18 cannot be pulled out any longer. To this end, the bent pieces 28 are formed at the upper portion of the terminal 26 by forming a slit or notch of "U" letter shape a shown in FIG. 3.

As shown in FIG. 4, terminal plates 30 and 32 are respectively arranged on opposite inner walls of the case 12. Contact pieces 30*a* and 32*a* each having a predetermined depressing force are formed on the terminal plates 30 and 32, respectively. Therefore, the terminal plates 30 and 32 are connected to the electrodes 20*a* and 22*b*, respectively by the contact pieces 30*a* and 32*a*. Terminals 34 and 36 each having the same or similar shape as the terminal 26 are integrally formed at lower portions of the terminal plates 30 and 32, respectively. In addition, the terminal 26 is formed at the lower left of the holding plate 18 as shown in FIG. 3, but the terminals 34 and 36 are formed at the lower center of the terminal plates 30 and 32 as shown in that figure. Therefore, the terminals 26, 34 and 36 are formed in a zigzag fashion so that workability of mounting the same on a printed circuit board increases.

In the PTC thermistor device 10 in accordance with the embodiment shown, since the plurality of throughholes 24 are formed in the holding plate 18, the heat generated by one PTC thermistor unit 20 can be suppressed from being conducted to the terminal 26. As a result of experimentation of the inventors, it was possible to reduce the temperature of the terminal 26 10°-20° C. in comparison with a conventional one. Therefore, even if the PTC thermistor device 10 in accordance with the embodiment is mounted on a printed circuit board, disadvantages such that solder is melted by the heat conducted or transferred from the terminal 26, and that other electronics components are thermally destroyed and so on are avoided.

Figure 1:
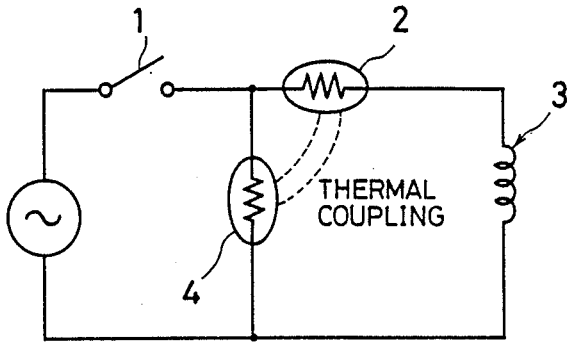
FIG. 1 PRIOR ART
FIG. 1 is a circuit diagram showing one example of a degaussing circuit of a CRT.
Figure 2:
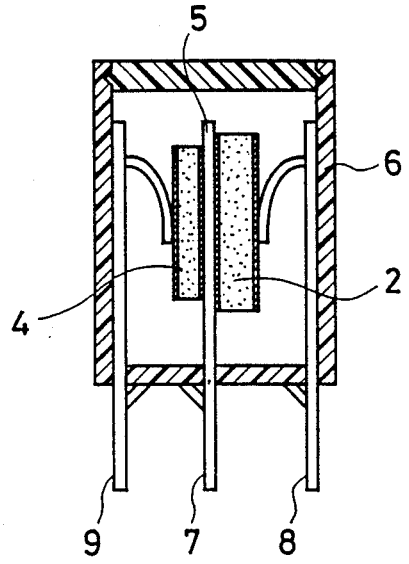
FIG. 2 PRIOR ART
FIG. 2 is an illustrative view showing a vertical section of a conventional PTC thermistor device.

Furthermore, since it is possible to use metallic material having a high coefficient of thermal conductivity as the holding plate 18, the thermal coupling of the PTC thermistors 20 and 22 becomes very strong, and thus the thermal equilibrium temperature of the PTC thermistor unit 22 can be maintained or set higher. Therefore, in the case where the PTC thermistor device 10 is utilized in the CRT circuit shown in FIG. 1, it is possible to minimize the current flowing in the degaussing coil after completing the degaussing operation.

Figure 5:
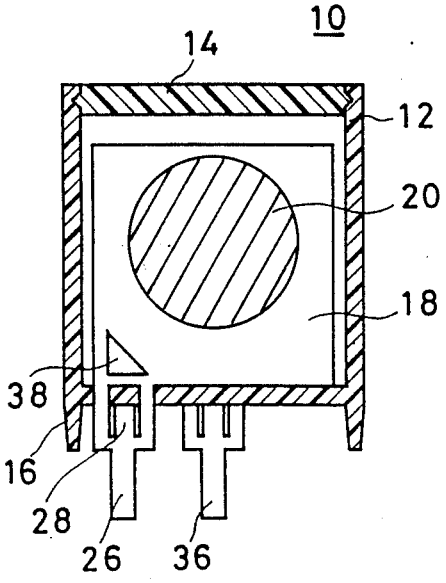
FIG. 5 is an illustrative view showing a transversal section of another embodiment in accordance with the present invention.
Figure 6:
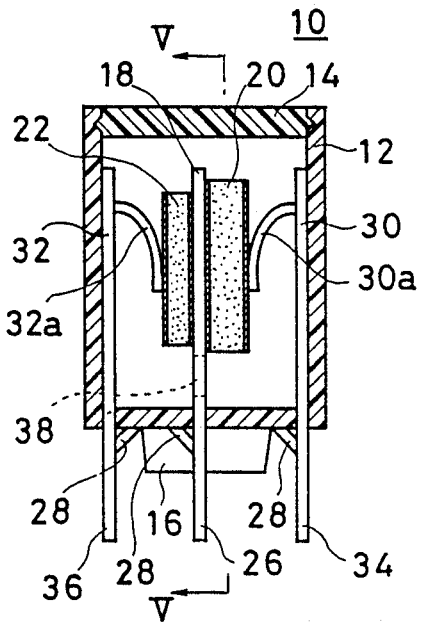
FIG. 6 is an illustrative view showing a vertical section of FIG. 5 embodiment.

FIGS. 5 and 6 are illustrative views respectively showing a transversal section and a vertical section of another embodiment in accordance with the present invention. In the previous embodiment, in order to suppress heat from being conducted from the holding plate 18 to the terminal 26, a plurality of throughholes 24 are formed on the holding plate 18. However, in this embodiment shown, a single triangular throughhole 38 is formed just above the terminal 26 to prevent or suppress the heat from being conducted from the holding plate 18 to the terminal 26.

In addition, in the above described embodiments, the holding plate 18 and the terminal 18 are formed in one-piece fashion by punching or blanking a single metallic plate, for example. However the holding plate 18 and the terminal 26 can be connected to each other via an electrical conductive material having a low coefficient of thermal conductivity. In this case, since heat conduction is impaired by a low-thermal-conductivity connection, heat can be suppressed from being conducted from the holding plate 18 to the terminal 26.

In addition, in the heat conduction-suppressing portion, it is desirable only that an area of a section is made smaller than that of the other portion, and therefore, an arbitrary shape such as a slit-like notch or a groove may be utilized rather than the throughholes 24 or 38 as shown in the illustrated embodiments.

Furthermore, in the above described embodiments, two PTC thermistor units 20 and 22 are fixed on both surfaces of the holding plate 18. However, only one PTC thermistor unit may be fixed to the holding plate 18.

Although the present invention has been described and illustrated in detail, it is clearly understood that the same is by way of illustration and example only and is not to be taken by way of limitation; the spirit and scope of the present invention being limited only by the terms of the appended claims.

What is claimed is:

1. A PTC thermistor device, comprising: a case;

a holding member housed in said case and made from metallic material;

a PTC thermistor unit having electrodes formed on both main surfaces thereof, one of said electrodes being connected to said holding member;

a first terminal connected to said holding member and exposed to outside said case;

a second terminal connected to the other of the electrodes of said PTC thermistor unit and exposed to the outside of said case; and a heat conduction-suppressing portion formed in a heat conduction path between said holding member and said first terminal for suppressing heat flow from said holding member to said first terminal.

2. A PTC thermistor device in accordance with claim 1, wherein said heat conduction-suppressing portion includes a portion where an area of a section is made smaller than the other portion of said heat conduction path.

3. A PTC thermistor device in accordance with claim 2, wherein said heat conductive-suppressing portion includes a throughhole formed in said heat conduction path.

4. A PTC thermistor device in accordance with claim 2, wherein said heat conductive-suppressing portion includes a notch formed in said heat conduction path.

5. A PTC thermistor device in accordance with claim 1, wherein said holding member and said first terminal are formed in one-piece fashion.

6. A PTC thermistor device in accordance with claim 1, wherein said holding member includes a holding plate on which the one of the electrodes of said PTC thermistor unit is fixed.

7. A PTC thermistor device in accordance with claim 6, wherein:

said holding member has a pair of main surfaces; and said PTC thermistor unit includes two PTC thermistor units each having a respective electrode connected to a respective one of said pair of main surfaces of said holding plate.

* * * * *